US005577757A

United States Patent [19]

Riepl et al.

[11] Patent Number: 5,577,757

[45] Date of Patent: Nov. 26, 1996

[54] BINDING SYSTEM FOR SLIDE BOARDS, PARTICULARLY SNOW BOARDS, AS WELL AS BOOTS FOR USE WITH SUCH A BINDING SYSTEM

[76] Inventors: Gunther Riepl, Hirtenstrasse 5, 93059 Regensburg; Reiner Roith, Alte Dinauer Strasse 15, 93183 Kallmunz, both of Germany

[21] Appl. No.: 196,391

[22] Filed: Feb. 15, 1994

[30] Foreign Application Priority Data

Feb. 17, 1993 [DE] Germany ..... 43 04 876.5
Apr. 8, 1993 [DE] Germany ..... 43 11 630.2

[51] Int. Cl.[6] ..... A63C 9/08

[52] U.S. Cl. ..... 280/624; 280/617

[58] Field of Search ..... 280/613, 611, 280/623, 624, 614, 615, 634, 627, 14.2, 617, 618, 625, 632; 36/117, 131

[56] References Cited

U.S. PATENT DOCUMENTS

| | | | |
|---|---|---|---|
| 2,705,150 | 3/1955 | Hansen | 280/627 |
| 3,905,613 | 9/1975 | Romeo | 280/613 |
| 3,947,051 | 3/1976 | Sittmann | 280/611 |
| 4,403,789 | 9/1983 | Hickey | 280/614 |
| 4,505,493 | 3/1985 | Gustavsson | 280/624 |
| 5,193,840 | 3/1993 | Spitaler et al. | 280/615 |

FOREIGN PATENT DOCUMENTS

| | | | |
|---|---|---|---|
| 2689776 | 10/1993 | France | 280/14.2 |
| 2809018 | 10/1978 | Germany | 280/611 |

*Primary Examiner*—Brian L. Johnson
*Assistant Examiner*—Michael Mar
*Attorney, Agent, or Firm*—Graham & James LLP

[57] ABSTRACT

A binding system for snow boards, comprising a front binding element and a rear binding element for holding a boot in place on the boards. The front binding element engages behind a surfaces or step on a front end of the boot. The rear binding element is formed by support jaws which receive a boot or its heel section between them. Each jaw is provided with at least one recess for receiving a projection laterally extending from the heel of the boot. When positioned, the projections are locked in place by means of hook shaped locking elements which are kept biased in a locking position by a spring member.

15 Claims, 8 Drawing Sheets

BINDING SYSTEM FOR SLIDE BOARDS, PARTICULARLY SNOW BOARDS, AS WELL AS BOOTS FOR USE WITH SUCH A BINDING SYSTEM

The present invention relates to a binding system for slide boards, particularly snow boards, and to a boot for use with such a system.

Bindings for snow boards are known and consist fundamentally of a front binding element and a rear binding element, the front binding element forming a hoop consisting of spring wire into which the sole of the boot used can be introduced via a part protruding from the front end of the sole of the boot. The rear binding element in known bindings also consists of an elastically deformable hoop of spring wire. On it there is a swingable clamping lever or beyond-dead-center lever which when the boot is fixed in the binding engages behind the boot on a part of the sole of the boot protruding in the region of the heel on the boot, and thus fastens it in the binding.

The known binding or known binding system has the disadvantage, among others, that the binding can be closed and opened only with the exertion of a large amount of force. This disadvantage is particularly serious, since when lifts are used, one of the two feet must be detached from the snow board for reasons of safety. Therefore, prior to each trip on a lift, a cumbersome opening of the binding requiring the application of force and, after each trip on a lift, an equally cumbersome closing with the use of force are necessary.

Furthermore, in the known binding system the fastening of the boot to the snow board or slide board is not optimal despite a clamping with great force, particularly also not with respect to the lateral fixing of the boot in the region of the heel. Even with high clamping forces there is namely the possibility of so-called uncontrolled lateral flex, as a result of which optimum control of the snow board and, in particular also, control of the edge pressure are not possible.

The object of the present system is to provide a binding system which avoids these disadvantages and, with simple, easy handling, assures a dependable fastening of the boot in the binding and thus on the snow board.

In order to achieve this object, a binding system is developed in accordance with the body of claim 1.

A boot for use in a binding system is developed in accordance with the body of claim 17.

In the binding system of the invention, a simple and convenient application of the binding or fastening of the boot to the binding is possible in the manner that, after introduction into the front binding element, at least one extension or projection is introduced into the recess in the rear binding element and locked there by the locking element. The fastening of the boot in the binding therefore takes place without clamping by hard springs which hold the boot on the slide board or snow board and thus without the expenditure of force. The loosening of the boot from the binding is also possible without the expenditure of force.

Forces acting transversely to the axis of the boot are taken up by the support surfaces on the rear binding element as well as by the mating surfaces on the boot which cooperate with said support surfaces. The support surfaces are, for instance, surfaces of said at least one recess and/or surfaces of the rear binding element outside said recess. The mating surfaces are either surfaces of said at least one projection and/or surfaces of the boot.

In a preferred embodiment of the invention, a projection is formed in the region of the heel of the boot on each side which extends in the lengthwise direction of the boot, the lengthwise direction of said projections then being transverse or perpendicular to the axis of the boot. By this development, there is then also possible a direct transmission of lever forces or moments or rotation acting around the axis of the boot between boot and snow board, such as the moments of rotation which occur upon the canting of the snow board. In this way, direct edge control with simultaneous mobility in the direction of travel is obtained.

Particularly when the front binding element of the binding system of the invention is also formed by a spring hoop, clamping of the boot between the front binding element and the rear binding element is obtained at all times with the same force, and in particular also with optimal force, in the case of the invention, so that unintended loosening of the boot from the binding is prevented by the dynamics of travel.

Further features of the invention will be described in further detail below with reference to the figures of the drawing, in which.

In the figures, 1 is a boot in the form of a special ski boot or snow-board boot which, in the region of its sole 2, at least on the front side of the boot, forms an edge or step 3 behind which a binding element can engage, as is customary also in the case of ski boots.

On the heel 4 the boot 1 has two projections 5 each of which protrudes beyond a side of the heel 4 which extends in the lengthwise direction of the boot. In the embodiment shown, the projections 5 are coaxial to each other transverse to the longitudinal axis of the boot and are formed of a length of a round bar of a material which can withstand high loads, preferably stainless steel, which passes through the boot in the region of the heel 4.

Figure 1:
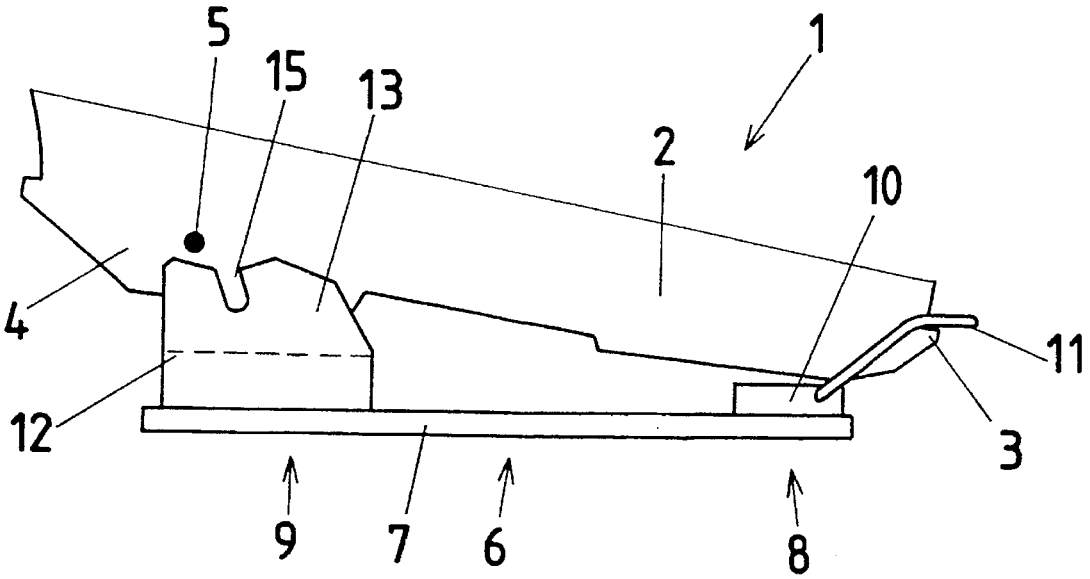
FIG. 1 is a simplified showing in side view of a binding for a slide board or snow board, together with a partial showing of a boot before the fastening of the boot in the binding.
Figure 2:
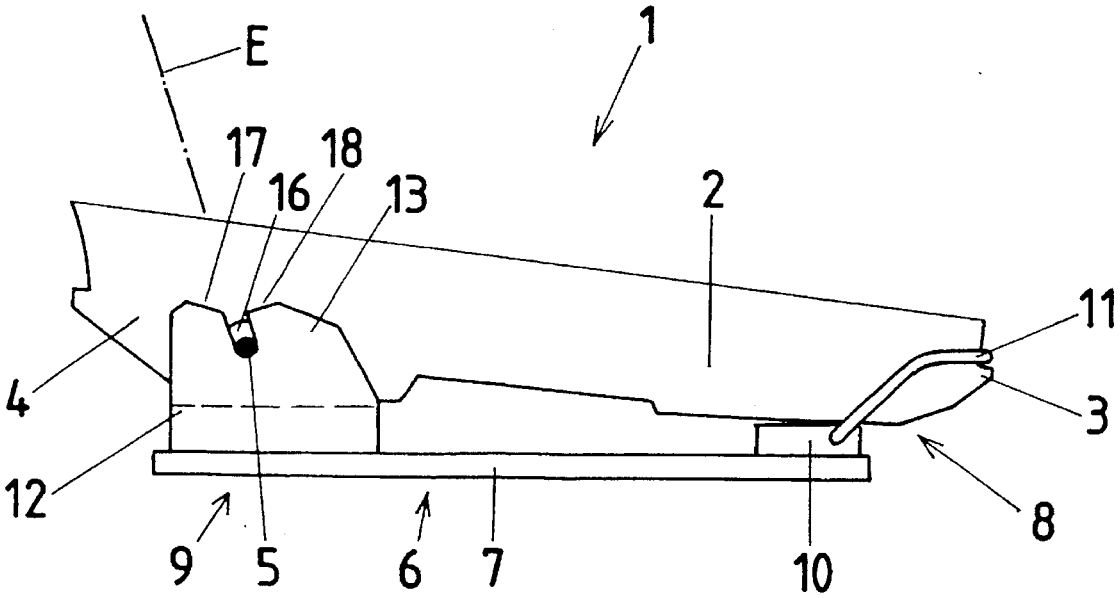
FIG. 2 is a showing similar to FIG. 1, but after the fastening of the boot in the binding.
Figure 3:
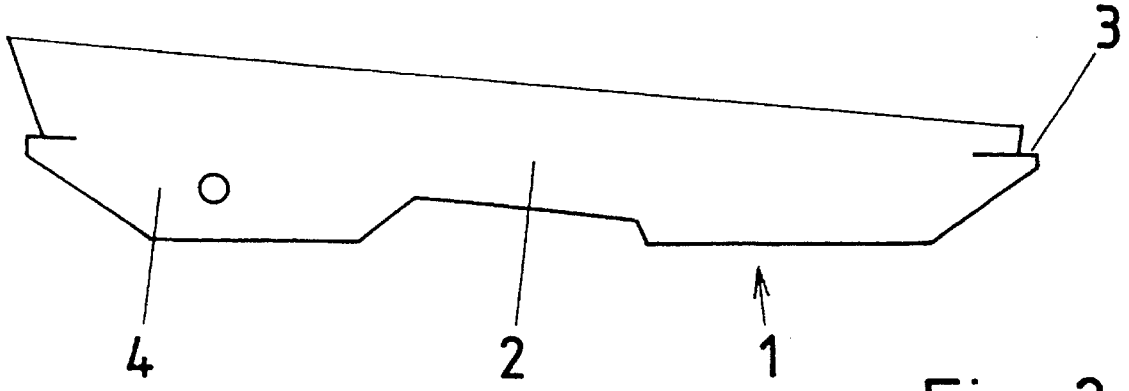
FIGS. 3 and 4 show the boot by itself, both in partial side view and in rear view.
Figure 4:
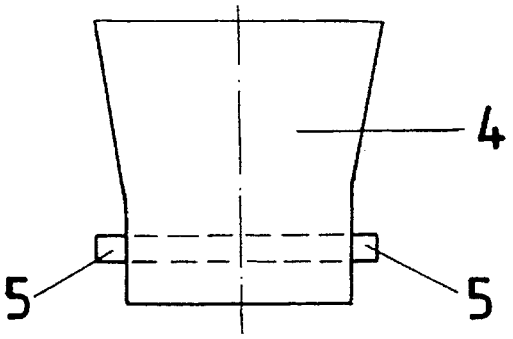

As shown in FIGS. 1 and 2, the binding 6 consists essentially of a base plate 7 the bottom side of which can be fastened to the top side of the snow board (not shown), on the top of which base plate there are fastened two binding elements, namely the front binding element 8 which consists of a plate 10 which is fastened to the top of the base plate 7 and bears a hoop 11, as well as the rear hoop element 9. At least one of the two hoop elements 8 and 9 is adjustable in the lengthwise direction of the base plate 7 so as to be able to adjust the binding 6 to shoes of different size. When the boot 1 is fastened in the binding 6, it is held on the hoop 11 by the step 3 and the bottom of the sole 9 lies, in the region of the front of the boot, on the plate 10 which is set back towards the rear with respect to the front of the boot. By this development of the front binding element 8, all parts of the binding are offset rearward with respect to the front end of the boot when the boot 1 is fastened in the binding 6 so that the binding 6 has a short length.

The rear binding element 9 forms, independently of a different embodiment, in detail two lateral support jaws 13 between which a surface 12 is provided and which receive, between each other, in the region of its heel 5, the boot 1 fastened in the binding 6, i.e. form, on their inner sides facing each other, vertical support surfaces 14 for the sides of the heel 4 which extend in the lengthwise direction of the boot. When the boot 1 is arranged in the binding 6 the surface 12 is spaced from the bottom of the sole 2 or heel 4 and is furthermore tilted or wedge-shaped so that any lump of snow adhering to the bottom of the heel is pushed off by the tilted surface 12 upon the insertion of the boot 1 into the binding.

Each support jaw 13 furthermore has a slot 15 which is open on the support surface 14 and on the top side of the support jaw facing away from the base plate 7, into which slot a projection 5 can be inserted in order to fix the boot 1 in the binding 6. By means of a binding mechanism or locking device with locking element 16, which will be described further below, each projection 5 can be locked in the corresponding slot 15.

In order to facilitate the introduction of each projection 5 into the corresponding slot 15, the top of each support jaw 13 is developed, at least in a part of its region, as an oblique surface 17 which, starting from the end of the binding element 9 or of the support jaw 13 remote from the binding element 8 passes extending obliquely in downward direction into the corresponding slot 15. A similar oblique surface 18 is also formed on the other side of the slot 15.

Furthermore, each slot 15 is inclined or oblique in such a manner that the lengthwise direction of this slot lies in a plane E which forms an angle which is smaller than 90° with the plane of the base plate 7 and opens towards the side facing away from the binding element 8.

For the fixing of the boot 1 in the binding 6, the front end of the boot is first of all introduced into the hoop 11 of the binding element 8. The binding is so adjusted that, after this introduction, each of the projections 5 is located at the upper end of the slot 15, i.e. approximately at the place of transition from the oblique surface 17 into this slot. By pressing the boot 1 down at the heel, each projection 15 is then introduced into the corresponding slot 15. As a result of the above-described inclination of the slot 15, the required clamping of the boot in the binding is obtained in the manner that the hoop 11 which forms an angled hoop plane is easily deformable elastically and thus, in particular, also reliably engages behind the step 3.

The binding 6 permits a simple attachment of the snow board to the boot 1 without the application of excessive force. Since the two binding elements 8 and 9 are fastened rigidly, or at least substantially rigidly, to the base plate 7, a rigid attachment of the boot 1 to the snow board which assures optimal steering of the snow board is also assured.

The rear binding element 9 may be of different development and may also be fastened in different manner to the base plate 7.

Figure 5:
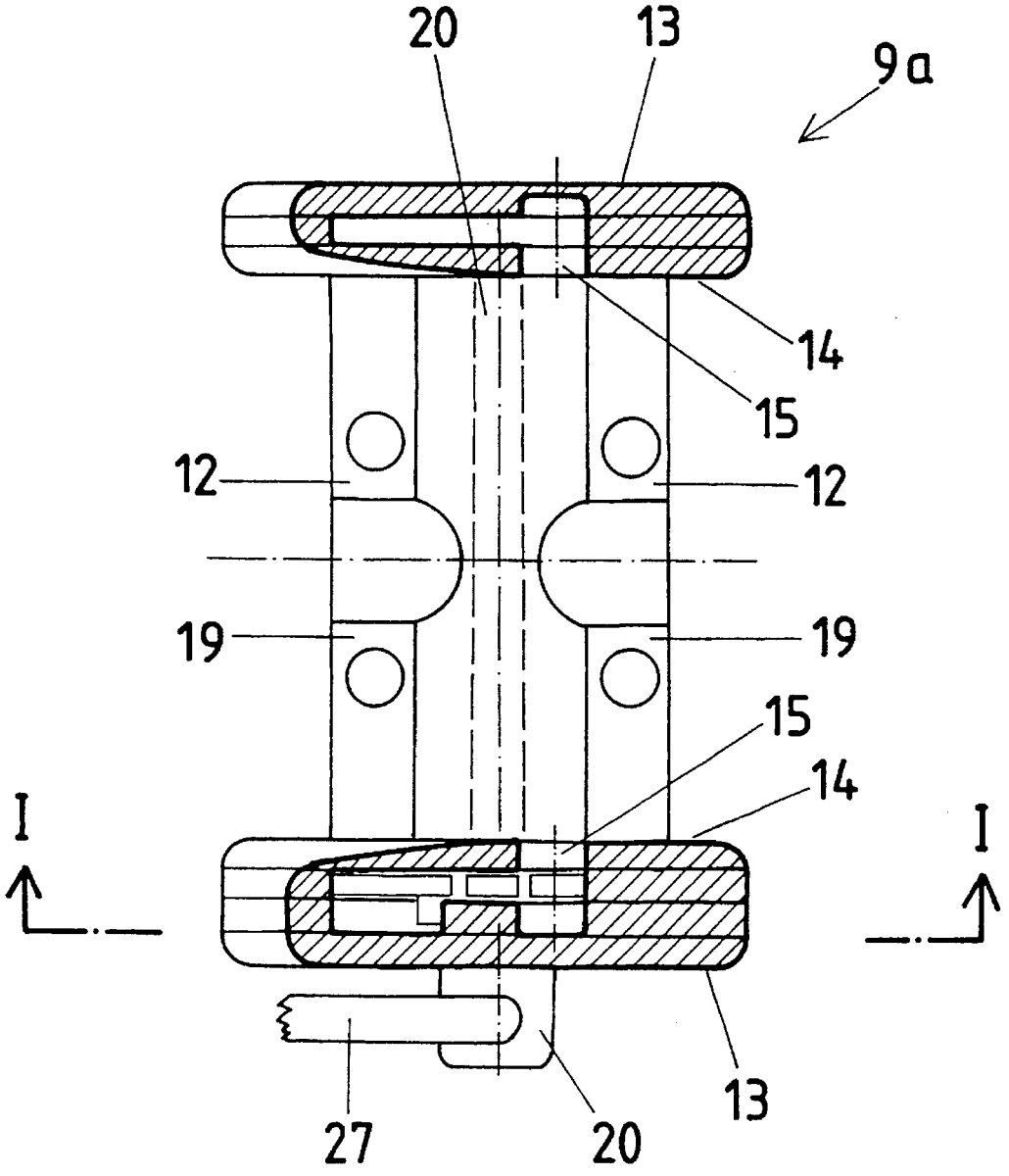
FIG. 5 is a top view of the rear binding element of a first possible embodiment of the invention.
Figure 6:
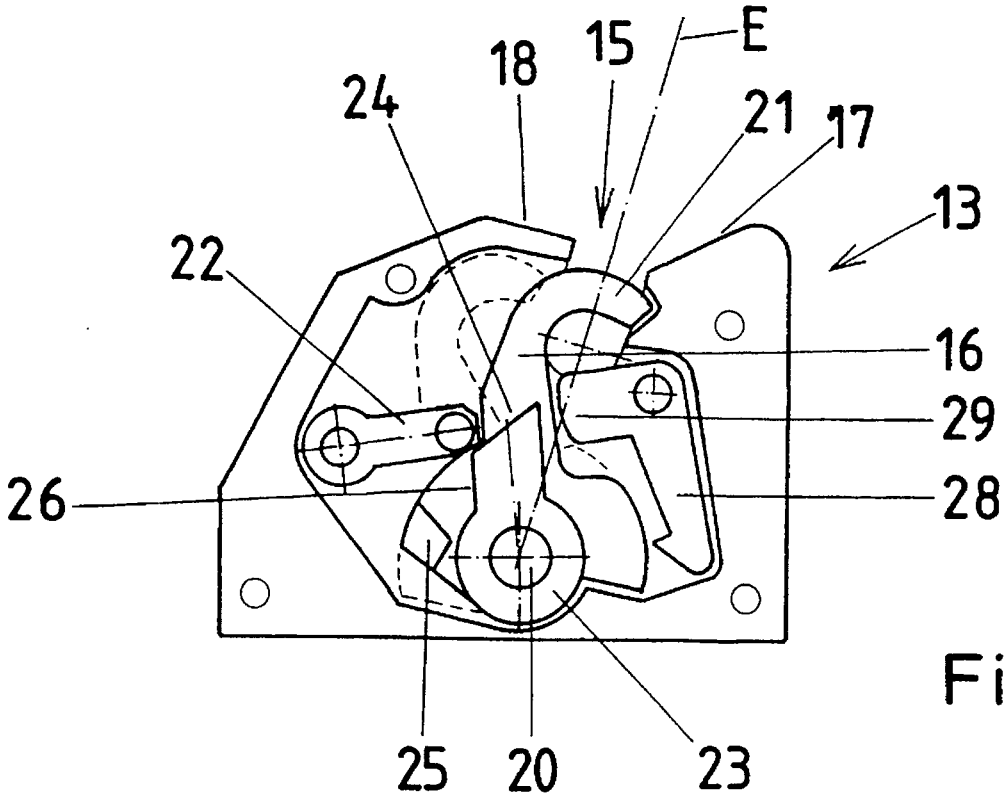
FIG. 6 is a section along the line I—I of FIG. 5.
Figure 7:
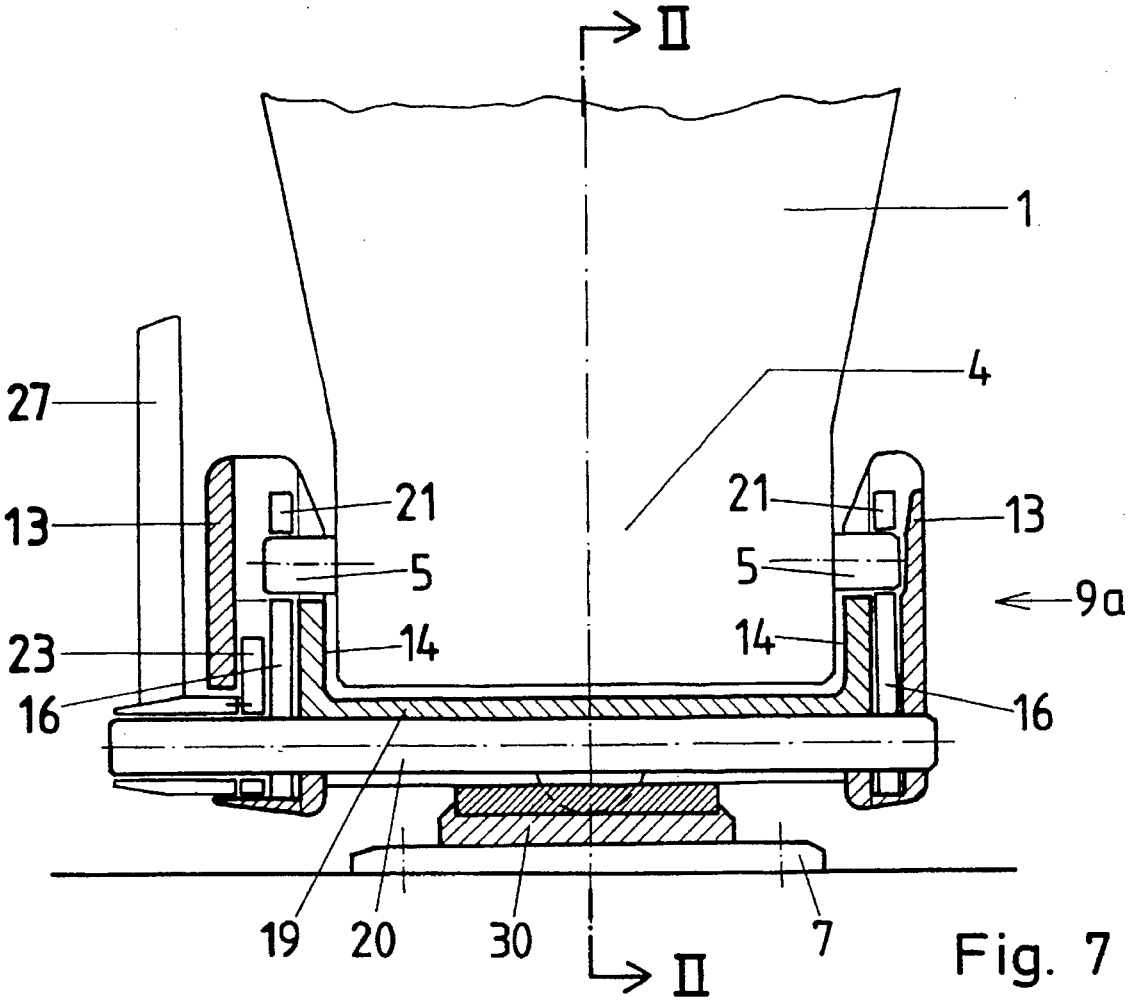
FIG. 7 is a rear view of the rear binding element of FIGS. 5 and 6 with a special type of attachment to the snow board or a base plate of the binding.
Figure 8:
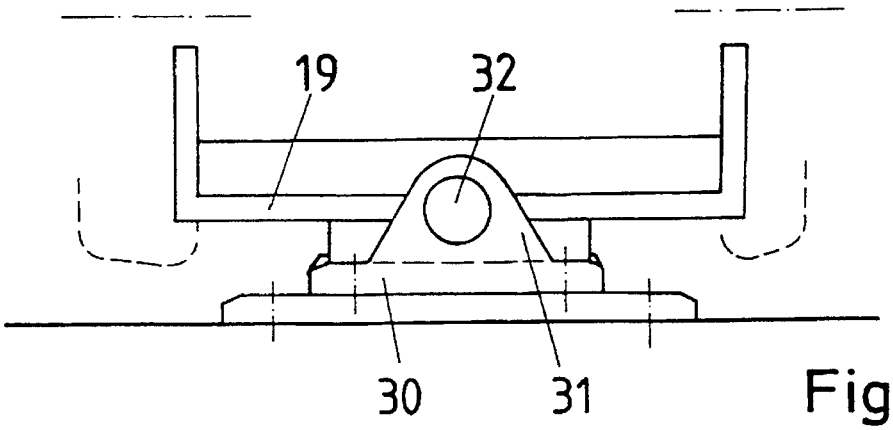
FIG. 8 is an individual view similar to FIG. 7 of a hoop-shaped connecting piece of the rear binding element.
Figure 9:
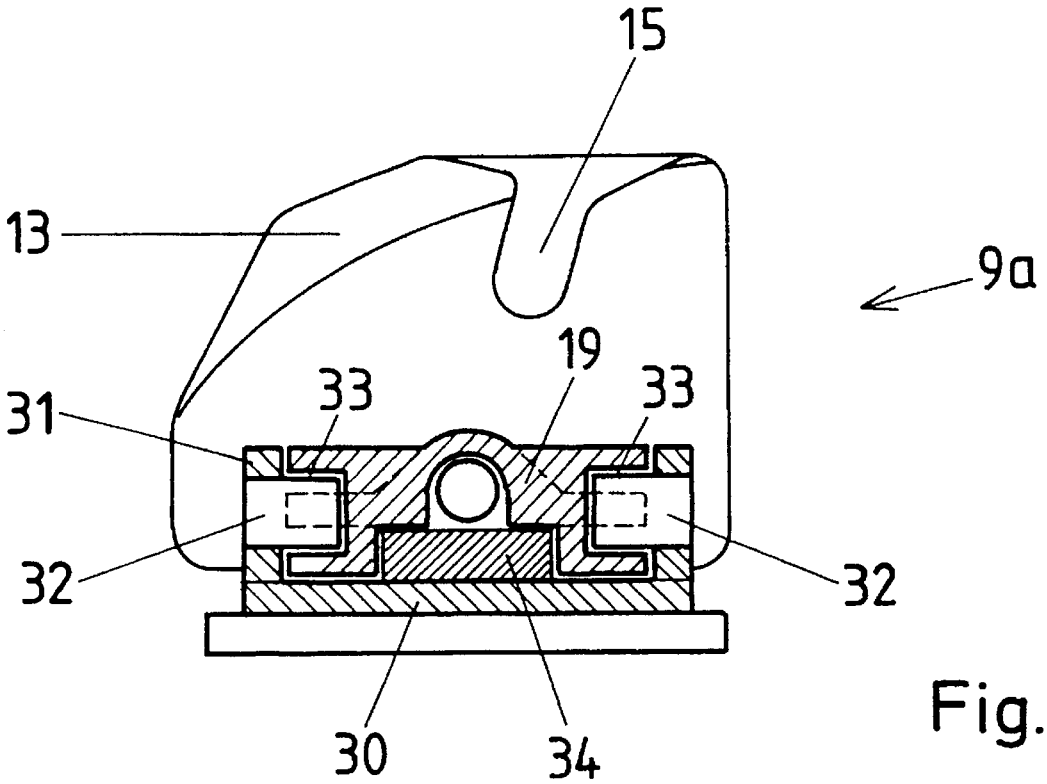
FIG. 9 shows the rear binding element in a section along the line II—II of FIG. 7.
Figure 10:
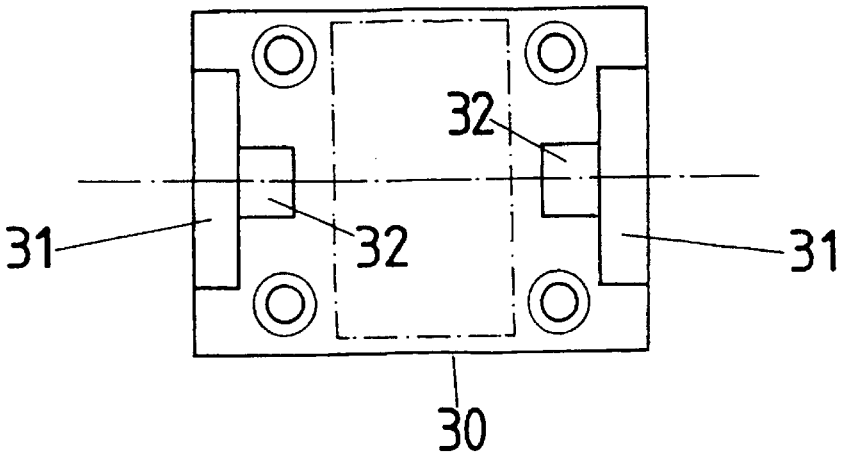
FIG. 10 is a top view of a fastening or support plate for the special holding of the rear binding element shown in FIGS. 7–9.

FIGS. 5 and 6 show, as possible embodiment, a binding element **9*a* in which the two section jaws 13, each of which is developed as housing are connected together and spaced from each other by two steel hoops or hoop-like connecting pieces 19, which also form the horizontal surface 12. By means of the connecting pieces 19, the binding element 9*a* is, for instance, directly screwed to the base plate 7**.

FIG. 6 shows in detail the elements of the locking device which are arranged in each housing-like support jaw 13. The locking device consists first of all of the hook-shaped locking element 16 which is arranged at one end below the surface 12 on a shaft 20 and is swingable with respect to it, the shaft extending between the two support jaws 13 and being swingably supported at both ends in them. The shaft 20 is located below the surface 12. The axis of the shaft 20 furthermore lies in the common plane E with the lengthwise direction of the slot 15 or its center line.

At the upper end, each locking element 16 forms a hook-shaped section 21 which, upon the swinging of the locking element 16 around the axis of the shaft 22 (sic), is swingable from a non-locking position shown in dashed line in FIG. 6 in which the locking element 16 or section 21 is located outside the slot 15 and to the side of it, it is swingable into a position in which the hook-shaped section 21 of the locking element 16 extends into the corresponding slot 15, and does so in the region of the upper end of said slot and thus engages behind a projection 5 arranged in the slot and thus prevents outward movement from the slot. By the above-described arrangement of the axis of the shaft 20 in the plane E, forces which act, via the projection 5, to move this projection out of the slot 15, do not act on the locking element 16 in the sense of a loosening of the locking or of a swinging of the locking element 16 back into the unlocked position. By spring elements (not further described), for instance a leaf spring, each locking element 16 which in the unlocked position is at the side of the slot 15 facing the binding element 8 is urged into the locking position.

The locking device furthermore comprises a safety lever 22 which is swingable around an axis parallel to the axis of the shaft 20, said lever resting in the locking position of the locking element 16 against a surface formed on said locking element, thereby preventing undesired swinging of the locking element 16 out of the locking position. On the shaft 20, there are provided, fixed for rotation, a driver 23 which forms a control surface 24 which cooperates with the safety lever 22 as well as a surface 26 which cooperates with a stop 25 on the locking element 16. An actuating lever 27 is provided on the shaft 20 at an end protruding beyond a support jaw 13. By swinging this actuating lever and thus the shaft 20, the locking element 16 which is in the locking position can be loosened. In this way, the safety lever 22 is first of all so swung by the control surface 24 that it releases the locking element 16. Upon further swinging of the driver 23, the surface 26 comes against the stop 25 whereby the locking element 16 is then carried along against the action of the spring (not shown) and swung into the unlocking position. A ratchet lever 28 engages behind the surface of the locking element 16 present in the unlocking position and holds it in the non-locking position. The ratchet lever 28 has a tail 29 which engages into the corresponding slot 15. For the safety lever 22 and the ratchet lever 28 there are also provided spring elements (not shown) which urge the safety lever into a position securing the locking element 16 in the locking position and the ratchet lever 28 into a position holding the locking element 16 in the non-locking position.

Figure 11:
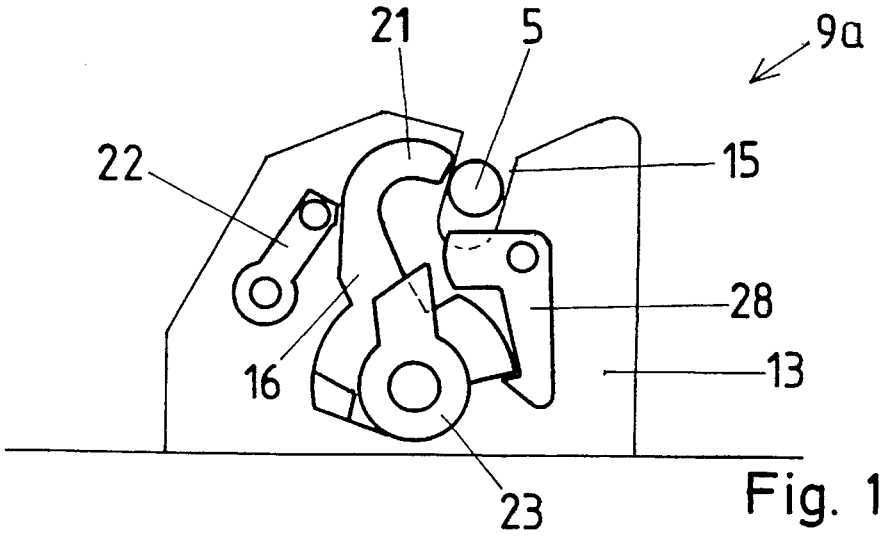
FIGS. 11–13 show the rear binding element of FIGS. 5 and 6 in a view similar to FIG. 6, in different functional positions.
Figure 12:
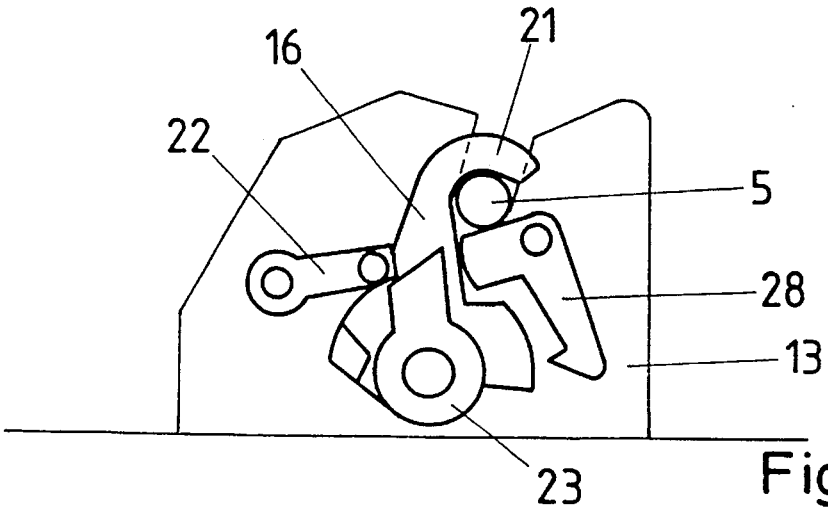
Figure 13:
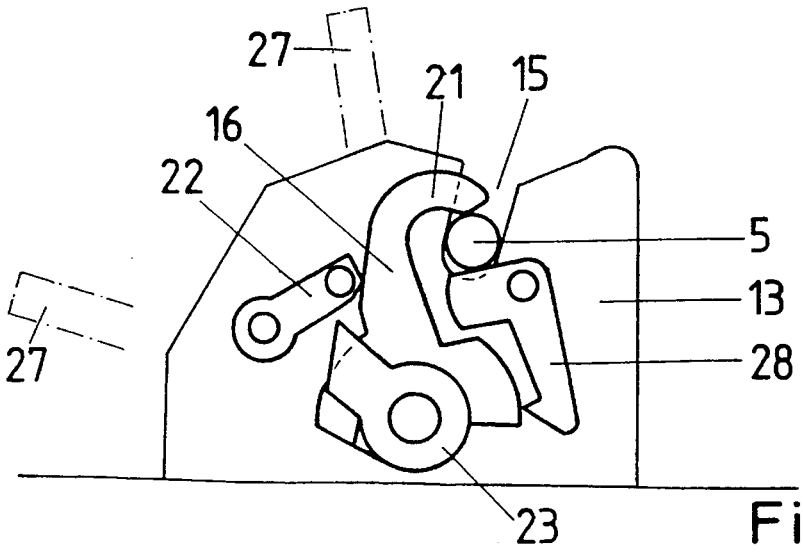

FIGS. 11–13 show the function of the elements of the locking device. FIG. 11 shows the introduction of a projection 5 into a slot 15 in the case of the unlocking locking element 16. When the projection 5 comes against the tail 29, the locking element 16 is released by the swinging of the ratchet lever 28, and the locking element then swings into the locking position shown in FIG. 12, in which the locking element 16 is also secured by the safety lever 22.

FIG. 13 shows the condition of the locking device upon unlocking by means of the actuating lever 27, the safety lever 22 having in this figure already released the locking element 16 and the driver 23 now resting against the stop 25.

In the embodiment shown in FIGS. 7 to 10, the binding element 9*a* is not absolutely rigid but is fastened with a certain possibility of movement to the base plate 7. For this purpose, an intermediate or fastening plate 30 is used on the side of the one surface of which there are provided two plate-shaped bearing elements 31 each of which has a journal or pin 32 which engages into an opening 33 which is provided in the connecting piece 19 between the two support jaws 13. The openings 33, the axes of which are parallel to the lengthwise direction of the base plate 7, have a cross section which is larger than the cross section of the pins 32. Between the intermediate plate 30 and the bottom of the connecting element 19 there is a rubber bumper 34 which, by elastic deformation, permits a certain movement of the binding element 9*a* relative to the base plate, namely by an amount which is determined by the play of the pins 32 in the openings 33.

Figure 14:
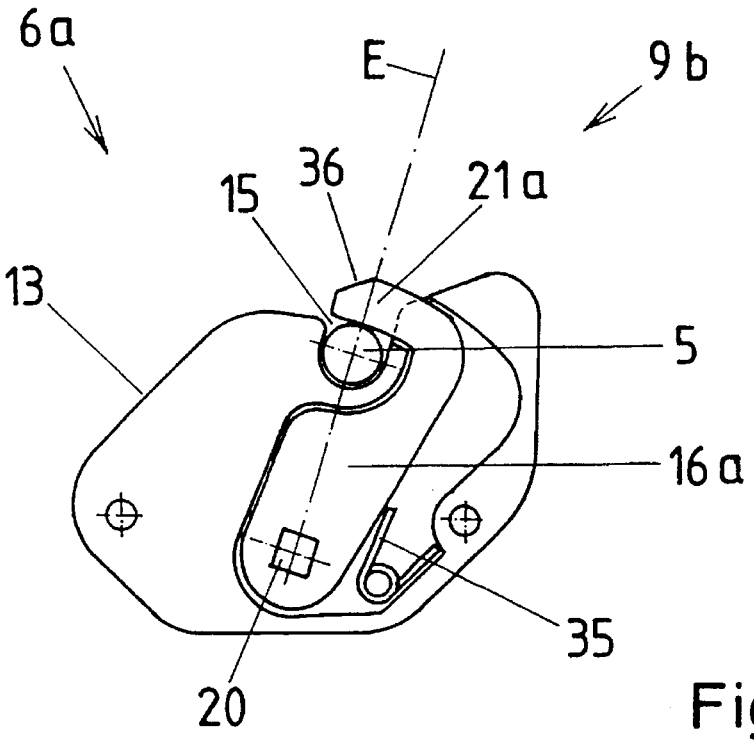
FIG. 14 shows, in a view similar to FIG. 6, the rear binding element in the case of a further, preferred embodiment.
Figure 15:
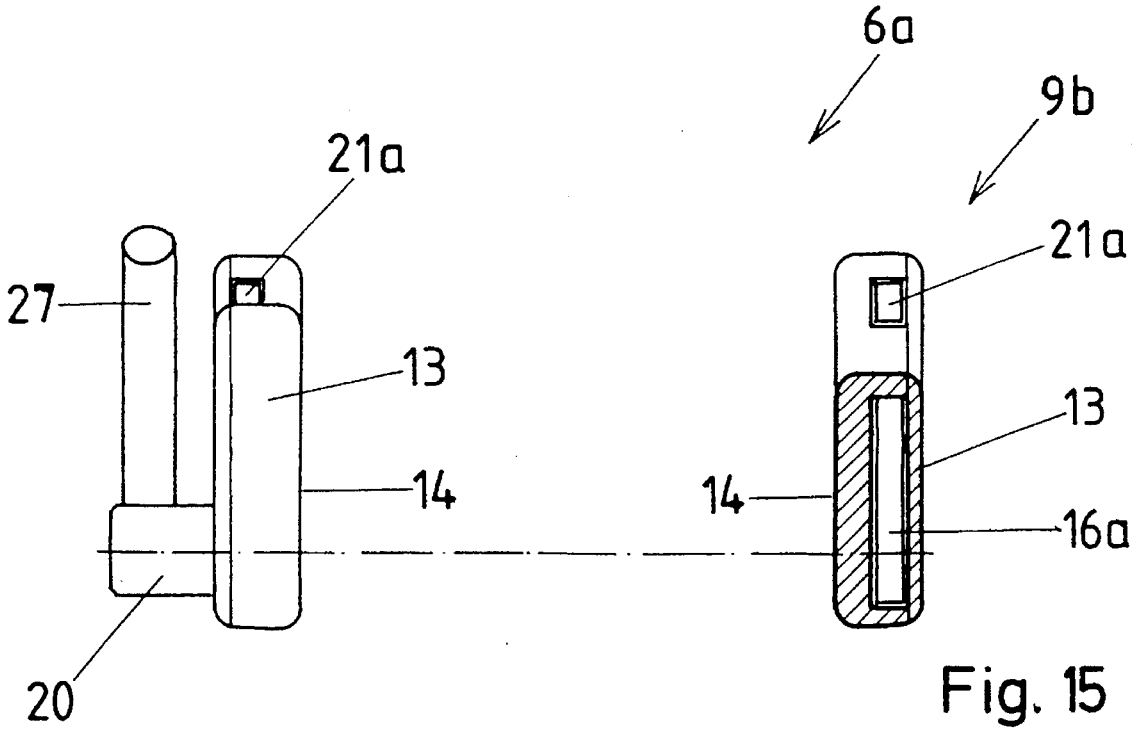
FIG. 15 is a rear view of the rear binding element of FIG. 14.

FIGS. 14 and 15 show, as preferred embodiment, a binding element 9*b* which, in its turn, consists of the two housing-side support jaws 13 each having a slot 15. Instead of the locking element 16, a locking element 16*a* is provided. The two locking elements 16*a* which in this embodiment are held, fixed for rotation, on the shaft 20 are in each case urged by a leaf spring 35 into the locking position, in which the hook-shaped section 21*a* of each locking element 16*a* protrudes from the housing-like support jaws 13 on the top and, outside the support jaw 13, closes the corresponding slot 15 at its upper open end and thereby locks a projection 15 seated in the slot 5. Furthermore, each locking element 16*a* is so developed that, upon swinging against the action of the spring 35, into the non-locking position it lies in this position with the hook-shaped section 21*a* against the side of the slot 15 facing away from the binding element 8.

On the free end of the hook-shaped section 21*a*, each locking element 16*a* forms an oblique surface 36 which lies in a plane extending parallel to the axis of the shaft 20, which plane forms an angle with the base plate 7 of less than 90° the angle being open towards the rear, i.e. towards the side of the binding element 9*b* facing away from the binding element 8. In order to fasten the boot 1 in this binding 6*a*, the front end of the boot 1 is again first of all introduced into the hoop 11 of the binding element 8. Thereupon, the heel 4 of the boot 1 is moved downward, the projections 5 moving approximately along a circular arc around the front end of the hoop 11, each projection thereby coming to rest against an oblique surface 36. Upon the further downward movement of the region of the heel of the boot 1, the projections 5 are introduced, with the moving away, under spring action, of the locking elements 16*a* into the corresponding slot 15 so that finally each locking element 16*a* swings back under the action of the leaf spring 35 into the locking position and thereby locks this projection 5 in the corresponding slot 15.

In the case also of the binding element 9*a*, the axis of the shaft 20 as well as the lengthwise direction of each slot 15 lies in the plane E which has the undescribed inclination. For the opening of the binding, the two locking elements 16*a* are swung via the actuating lever 27 and the shaft 20 into the unlocking position.

The binding 6*a* and its binding element 9*b* are characterized by an extremely simple and therefore very dependable construction. The locking devices do not have a large number of parts. Rather, the number of parts are reduced essentially to the hook-shaped locking elements 16*a*.

The invention has been described above with reference to an illustrative embodiment. It is obvious that changes and modifications are possible without thereby going beyond the scope of the inventive concept forming the basis of the invention.

We claim:

1. A system for binding a boot on a snow board, with said boot having projections laterally extending from a heel thereof, wherein said system comprises:

a) a front binding element having a holding element for engaging behind one of a surface and a step on the front end of the boot;

b) a rear binding element comprising two support jaws and locking means, with the region of the heel of the boot being adapted to be fastened between the support jaws and wherein the locking means is adapted to engage the projections, thereby fixing the boot in said rear binding element;

wherein each of said support jaws comprises at least one recess having an open end facing away from the snow board, with each of said recesses being sized and positioned for introduction therewithin of one of said projections, such that, after said introduction, the projections respectively extend transversely into the respective recesses; and wherein the locking means comprises hook-shaped elements adapted to respectively engage the transversely extending projections whereby the projections are prevented from being removed from the respective recesses, said hook-shaped elements being pivotally mounted on respective support jaws about an axis extending parallel to the projections, for a movement between a locking position, in which a hook shaped locking section of the locking element extends over the recess and closes the opening of the recess, and a non-locking position, in which the locking section lies outside the recess, wherein said rear binding element further comprises means for biasing the hook shaped elements in a locking position to engage and hold the projections of the boot, said binding system further comprising means for permitting the manual moving of the locking elements into an unlocking position; wherein each support jaw comprises a housing containing one of the locking elements; and wherein the two support jaws, which receive the boot therebetween in the region of the heel, form support surfaces for said heel, with said boot being fixed thereby in the rear binding element, said support surfaces lying:

i) in a first axial direction extending perpendicular to a lengthwise axis of the boot and substantially parallel to a bottom of the boot, ii) in a second axial direction extending perpendicular: to the bottom of the boot and perpendicular to the first axial direction, and iii) in a third axial direction extending perpendicular to the first and the second axial direction and parallel to a lengthwise axis of the boot.

2. A binding system according to claim 1, wherein said biasing means comprises a spring member adjacent each of the hook-shaped elements which urges the adjacent hook-shaped element into the locking position.

3. The system for binding according to claim 2, wherein each of said projections can be locked by spring engagement in the recess by the locking means.

4. A system for binding a boot on a snow board, with said boot having projections laterally extending from a heel thereof, wherein said system comprises:

a. a front binding element having a folding element for engaging behind a surface or step on the front end of the boot;

a. a rear binding element comprising two support jaws and locking means, with the region of the heel of the boot being adapted to be fastened between the support jaws and wherein the locking means is adapted to engage the projections, thereby fixing the boot in said rear binding element;

wherein each of said support jaws comprises at least one recess having an open end facing away from the snow board, with each of said recesses being sized and positioned for introduction therewithin of one of said projections, such that, after said introduction, the projections respectively extend transversely into the respective recesses; and wherein the locking means comprises hook-shaped elements adapted to respectively engage the transversely extending projections whereby the projections are prevented from being removed from the respective recesses, said hook-shaped elements being pivotally mounted on the respective support jaw about a locking-element-pivotal-axis extending parallel to the projections, for a movement between a locking position, in which a hook-shaped locking section of the locking element extends over the recess and closes the opening of the recess, and a non-locking position, in which the locking section lies outside the recess;

wherein the two support jaws, which receive the boot between them in the region of the heel, form support surfaces for said heel; with said boot being fixed thereby in the rear binding element;

i. in a first axial direction extending perpendicular to a lengthwise axis of the boot and substantially parallel to a bottom of the boot, i. in a second axial direction extending perpendicular to the bottom of the boot and perpendicular to the first axial direction, and i. in a third axial direction extending perpendicular to the first and the second axial direction and parallel to a lengthwise axis of the boot;

wherein said rear binding element further comprises means for biasing the hook-shaped elements in a locking position to engage and hold the projections of the boot and also means for permitting the manual moving of the hook-shaped locking elements into the locking position;

wherein the recess in each support jaw is in the form of a slot, with a lengthwise direction of each slot lying in a plane which forms an acute angle with a plane of the bottom side of the boot which is open to the side of the rear binding element which side faces away from the binding element, said pivotal axis of the hook-shaped locking elements lying also in said plane.

5. The system for binding according to claim 4, wherein at least one locking element further comprises a holding element which holds the hook-shaped locking element in a non-locking position.

6. A binding system according to claim 4, wherein each support jaw comprises a housing containing one of the hook shaped locking elements.

7. A binding system according to claim 4, wherein the recess in each support jaw is in the form of a slot.

8. A binding system according to claim 7, wherein a lengthwise direction of each slot lies in a plane which forms with a plane of the bottom side of the boot an acute angle which is open on the side of the rear binding element which side faces away from the front binding element.

9. A binding system according to claim 4, wherein each of said projections comprises a pin which is anchored in the heel region of the boot, which protrudes beyond the surface of the boot.

10. A binding system according to claim 4, wherein each of said projections is extends from the heel region of the boot, on each of the sides extending in the lengthwise direction of the boot.

11. A binding system according to claim 4, wherein at least one hook-shaped element is a spring detent element positioned in such a manner that, upon introduction of the projection into the recess, the hook-shaped element is moved, against the action of a spring, out of the locking position into the non-locking position and, after the introduction of the projection into the recess, the hook-shaped element returns into the locking position and thereby locks the projection in the recess.

12. A binding system according to claim 4, wherein at least one element of the locking means comprises a safety element adapted to block the hook-shaped element in the locking position.

13. A binding system according to claim 4, wherein at least one recess forms with a surface, a further support surface for the boot in the second and third axial directions.

14. A binding system according to claim 4, wherein the rear binding element has a wedge-shaped surface which, when the boot is arranged in the binding, is located below the heel of the boot and at least partially spaced from the heel.

15. A boot for use in the snow board binding system according to claim 4, wherein at least one projection protrudes, at the region of the heel, beyond the outer surface of the boot.

* * * * *